US008679610B2

(12) United States Patent
Kruelle et al.

(10) Patent No.: US 8,679,610 B2
(45) **Date of Patent: *Mar. 25, 2014**

(54) ENHANCED VOID BOARD

(75) Inventors: John M. Kruelle, Glendale, AZ (US); Antonio W. Brister, Buckeye, AZ (US); David J. Duke, Salisbury, NC (US)

(73) Assignee: Illinoise Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/125,303

(22) Filed: May 22, 2008

(65) Prior Publication Data

US 2008/0311335 A1 Dec. 18, 2008

Related U.S. Application Data

(63) Continuation-in-part of application No. 11/761,609, filed on Jun. 12, 2007.

(51) Int. Cl.

| | |
|---|---|
| ***B32B 3/28*** | (2006.01) |
| ***B65D 65/28*** | (2006.01) |
| ***A47F 1/04*** | (2006.01) |

(52) U.S. Cl.

USPC ..... 428/43; 428/167; 428/212; 428/213; 211/59.4

(58) Field of Classification Search

USPC ..... 428/131, 156, 167, 169, 212, 213; 211/49.4, 59.4; 248/346.01, 634; 206/322; 108/51.1

See application file for complete search history.

(56) References Cited

U.S. PATENT DOCUMENTS

| | | | | | |
|---|---|---|---|---|---|
| 1,948,327 | A | * | 2/1934 | Berwick | 428/138 |
| 2,534,137 | A | * | 12/1950 | Lewis | 428/169 |
| 2,681,377 | A | * | 6/1954 | Smithers | 429/253 |
| 2,869,721 | A | | 1/1959 | Baumer | |
| 2,962,163 | A | | 11/1960 | Else | |
| 2,975,089 | A | * | 3/1961 | Hargreaves | 428/168 |
| 3,274,315 | A | | 9/1966 | Kawamura | |
| 3,449,482 | A | * | 6/1969 | Mitchell et al. | 264/108 |
| 3,478,138 | A | | 11/1969 | Friesner | |
| 3,685,229 | A | | 8/1972 | Sale et al. | |
| 3,919,379 | A | | 11/1975 | Smarook | |
| 3,941,157 | A | * | 3/1976 | Barnett | 138/115 |
| 4,245,013 | A | | 1/1981 | Clegg et al. | |
| 4,465,729 | A | | 8/1984 | Cancio et al. | |
| 4,536,362 | A | | 8/1985 | Donaldson | |
| 4,559,254 | A | * | 12/1985 | Suzuki | 428/131 |
| 4,816,316 | A | | 3/1989 | Robbins, III | |

(Continued)

FOREIGN PATENT DOCUMENTS

| | | |
|---|---|---|
| NL | 6602815 | 9/1967 |
| WO | WO2007055662 | 5/2007 |
| WO | 2008154140 | 12/2008 |

OTHER PUBLICATIONS

German Search Report for GB0504832.4 dated Jun. 7, 2005.

(Continued)

*Primary Examiner* — Donald J Loney

(74) *Attorney, Agent, or Firm* — Levenfeld Pearlstein, LLC

(57) ABSTRACT

An enhanced polymeric void board for placement between adjacent horizontal layers of masonry materials to maintain an opening in a lower of the layers, the enhanced void board comprising a relatively thin planar element having a plurality of ribs extending along the length of the planar element.

11 Claims, 2 Drawing Sheets

(56) References Cited

U.S. PATENT DOCUMENTS

| | | | | |
|---|---|---|---|---|
| 5,310,593 | A | 5/1994 | Tsujimoto et al. | |
| 5,658,644 | A * | 8/1997 | Ho et al. | 428/188 |
| 5,946,878 | A | 9/1999 | Grund et al. | |
| 6,827,179 | B2 | 12/2004 | Drake et al. | |
| 6,989,184 | B2 | 1/2006 | Duke et al. | |
| 2005/0204707 | A1 * | 9/2005 | Duke et al. | 53/445 |
| 2006/0283142 | A1 | 12/2006 | Varma et al. | |

OTHER PUBLICATIONS

International Search Report for PCT/US08/64499 dated Aug. 15, 2008.

International Search Report for PCT/US2009/040591 Dated Jun. 17, 2009.

* cited by examiner

ENHANCED VOID BOARD

BACKGROUND OF THE INVENTION

The present invention relates generally to an enhanced polymeric board used as a void board. More particularly, the present invention relates to a fabricated, topologically reinforced and static-reduced void board for use in forming bundles of uniform masonry materials such as bricks.

Bricks, or other masonry materials, are typically bundled as a plurality of stacked individual units (i.e., individual bricks) formed into a 3-dimensional bundle. The bundle includes one or more package straps, corner protectors, and a void board that is placed between two horizontal layers of bricks. Generally, the void board is placed above a layer of bricks that has bricks omitted, e.g., forming two apertures in the bundle. Additional layers of bricks are placed on top of the board. The apertures, which are typically centrally disposed, are configured to allow the prongs of a forklift or similar device to pass into the bundle. In moving the package of bricks, the forklift exerts a force on the underside of the board, to lift the entire package. Typically, the apertures are formed extending through the entire depth of the bundle.

One known void board is formed as a veneer. These veneer void boards are often of poor quality and have a tendency to warp. Warping results in uneven surfaces upon which layers of bricks are stacked, which in turn can result in package instability. Moreover, veneer void boards do not allow clean "separation" of the brick layers (in the depth direction) from the bundle, in that there is no easy way to separate the bricks and sever or cut the board at the juncture of that layer and the remainder of the brick bundle.

Other void boards use solid or ribbed plastic sheets. Such void boards are disclosed in Duke et al., U.S. Pat. No. 6,989,184 and in Varma, et al., U.S. patent application Ser. No. 11/156,331, both commonly assigned with the present application and incorporated herein by reference. While void boards have been found to function well at a given thickness, they require a higher material weight (and thus, cost) than desired for such a consumable item. When a thinner sheet is used (and thus, less material), it has been found that the boards may not have the desired stiffness.

Accordingly, there is a need for a void board that is of consistent quality, reliability, and strength to allow stable stacking of bricks for bundle forming, without crushing the board. Desirably, such a void board is readily severed for separating layers of bricks and readily separable from other void boards. More desirably, such a void board endures environmental conditions without warping. Most desirably, such a void board is fabricated or manufactured such that a lesser weight of material is used to provide a sufficiently stiff board.

SUMMARY OF THE INVENTION

An enhanced polymeric void board is configured for placement between adjacent horizontal layers of masonry materials, such as bricks, to maintain an opening in a lower layer of the bricks. The opening is configured for insertion of a prong of a forklift for transporting the bundle of bricks.

The enhanced void board is fabricated from a relatively thin, planar element having a plurality of ribs extending along the length of the surface of the planar element. The enhanced void board is fabricated by extruding a base material in sheet form and embossing the extruded material such that the result resembles ribs. The extruded void board is then cooled.

In one embodiment, the ribs are formed in parallel rows, extending longitudinally along the length of the enhanced void board, wherein the on-center distance between adjacent ribs is approximately 2.250 inches. Holes can be formed in the enhanced void board in the spaces defined by the ribs.

In an alternate embodiment, the extruded material may be embossed in a cross-hatch pattern, defining a diamond-shaped space. Holes can be positioned within the diamond-shaped spaces. It is understood that any variation or pattern of ribs of the enhanced void board seeking to strengthen the product while reducing part of the weight is in the spirit of the invention.

Optionally, the enhanced void board can be fabricated with weakened regions formed in the board, generally parallel to the ribs and aligned with one another. This provides a plurality of frangible regions for separating a portion of the enhanced void board from another portion of the enhanced void board such that the masonry materials, which rest on the enhanced void board, may also be easily separated from the group of materials.

The enhanced void board can be extruded from polyvinyl chloride (PVC), acrylonitrile butadiene styrene (ABS), polystryrene (PS), polyethylene (PE), and other similar polymers and blends thereof. In addition, enhanced void board may be extruded from filled polymers, including, but not limited to paper fiber, wood fibers, and minerals.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
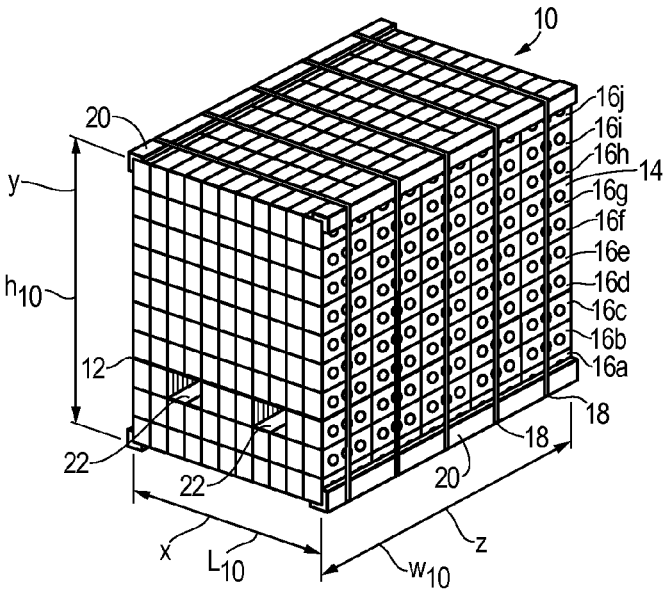
FIG. 1 is a perspective view of a bundle of bricks having an enhanced void board embodying the principles of the present invention disposed between horizontal layers of bricks.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

It should be understood that the title of this section of this specification, namely, "Detailed Description Of The Invention", relates to a requirement of the United States Patent Office, and does not imply, nor should be inferred to limit the subject matter disclosed herein.

With reference now to the figures and in particular to FIG. 1, a bundle 10 of bricks is shown with one embodiment of an enhanced void board 12 in accordance with the principles of the present invention. The bundle 10 is a 3-dimensional stack of individual bricks 14 that form a matrix with a plurality of horizontal layers, e.g., 16*a*-16*j*. The stack 10 thus defines a length $l_{10}$, a height $h_{10}$ and a width $w_{10}$, which are represented by the x, y and z-axes as shown.

The bundle 10 is maintained in the 3-dimensional configuration by straps 18 that are positioned about the bundle 10. In a typical bundle 10, vertical straps (in the y-direction) are positioned around the bundle 10 extending in both the x and z-directions. Horizontal straps can be, but generally are not used. Corner protectors 20 are disposed along the corners of the brick bundle 10 between the bricks 14 and strap 18 to protect the bricks 14 from damage due to rubbing and accidental bumping. The corner protectors 20 also preclude strap 18 failure due to, for example, abrasion.

In order to readily transport the bundle 10, openings 22 are formed in the bundle 10 by removing or eliminating bricks in a predetermined area of the matrix. The openings 22 are configured to permit the insertion of the prongs of a forklift. In this manner, the prongs can be inserted into the openings 22 and the bundle 10 raised and transported as desired.

Figure 3:
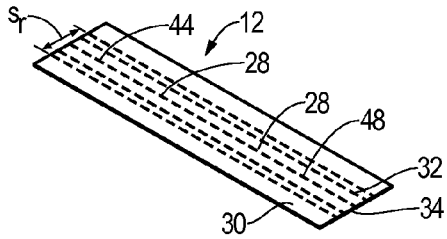
FIG. 3 is a top view of one embodiment of the enhanced void board of the present invention.
Figure 4:
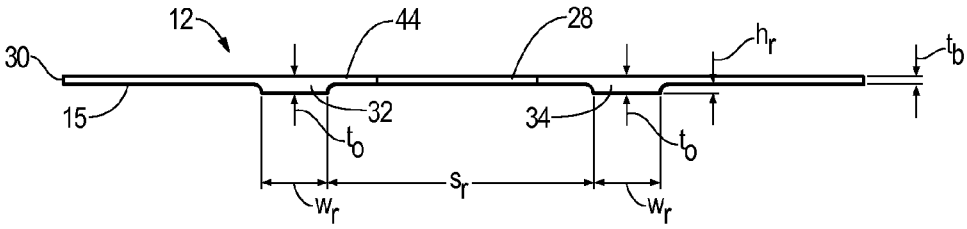
FIG. 4 is a side view, as indicated in FIG. 3, illustrating the rib and board end profile.

To maintain the layer 16*d* of bricks 14 above the opening 22, the enhanced void board 12 is placed between the horizontal layers 16*c* and 16*d* of bricks 14, that is, above the layer 16*c* in which the openings 22 are formed. One embodiment of the enhanced void board 12 is illustrated in FIGS. 3 and 4. The board 12 is fabricated as an extruded base element 30. The element 30 has a thickness $t_b$ of about 0.063 inches. A plurality of ribs 32, 34 extend longitudinally along the length $l_{10}$ of the void board 12 to a height $h_r$ of about 0.063 inches from a first surface 15. In a present board 12, the ribs 32, 34 are parallel and are generally equal in height.

In a present embodiment, the board 12 has an overall thickness $t_0$ (including the thickness of the base element and the height of the ribs) of about 0.125 inches. The ribs 32, 34 have a width $w_r$ of about 0.500 inches and are spaced $s_r$ from adjacent ribs about 2.0 inches apart and preferably about 2.250 inches on center.

Figure 3A:
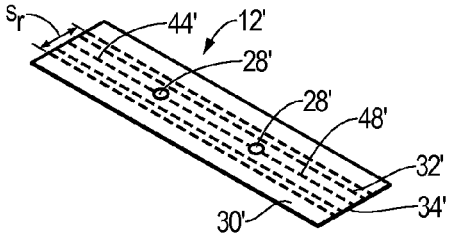
FIG. 3A is an alternate embodiment of the void board similar to that shown in FIG. 3.
Figure 5:
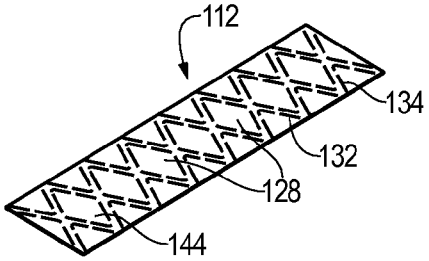
FIG. 5 is a top view of an alternate embodiment of the void board (with cross-hatch pattern)
Figure 6:
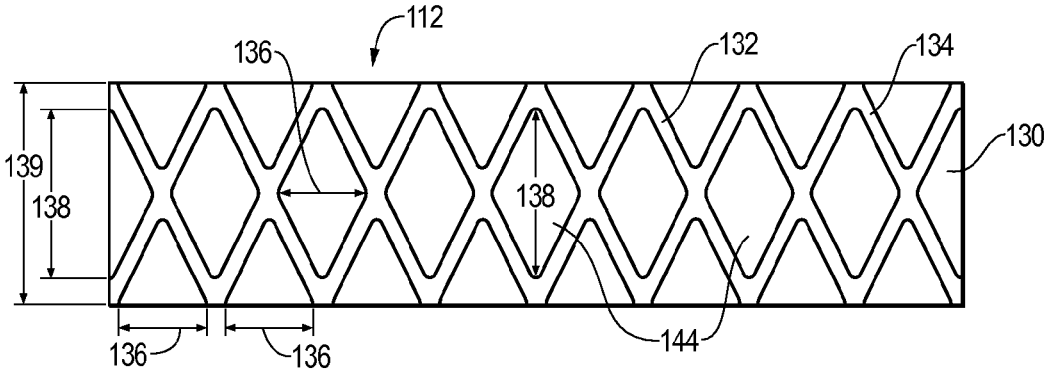
FIG. 6 is an enlarged view of the board of FIG. 5, illustrating the rib and board profile.

An alternate embodiment 12' of the straight ribbed void board is shown in FIG. 3A. In this embodiment 12', holes 28' are fabricated in the board 12' between the ribs 32', 34' of board 12'. The holes 28' can be located longitudinally along board 12' in the same location in each board or the longitudinal location can vary among boards. The holes 28' provide an opening through which air can move as a board 12' is lifted from a stack of boards. The air will tend to create resistance to "lifting" of the next lower board and thus tend to facilitate grasping and moving single boards at a time. The holes 28' also reduce the negative pressure region that is created below the board 12' as it is grasped and pulled upward, also reducing the potential for grasping more than one board at a time. This tends to reduce the effect of static electricity or other "sticking" inherent in thermoplastic materials and to allow for easier lift and separation of the thermoplastic sheets or boards 12' from one another prior to insertion into bundle 10', An alternate embodiment of the void board 112 is illustrated in FIGS. 5 and 6. In this embodiment, the board 112 is extruded and embossed such that the extruded material has a ribbed cross-hatch pattern defining a diamond shape, as shown generally at 132, 134. This configuration of the board 112 produces an apparent thick ribbed sheet. The spaces defined by the cross-hatching of the ribs 132, 134 provide a plurality of diamond-shaped void spaces 144. The enhanced void board has an overall thickness $t_{oa}$ (including the thickness of the base element 130 and the height of the ribs) of about 0.125 inches. The ribs, 132, 134 have a width of about 0.500 inches and are cross-hatched to form diamond-shaped void spaces 144 with curved corners. The centers of the diamond-shaped spaces are regularly spaced approximately 3.000 inches apart. A first inner diagonal dimension 136 of the diamond-shaped void spaces measures about 2.500 inches and a second inner diagonal dimension 138 of the diamond-shaped void space measures about 4.375 inches. A third outer diagonal dimension 139 of the diamond-shaped void space 144 measures about 6.000 inches.

Figure 5A:
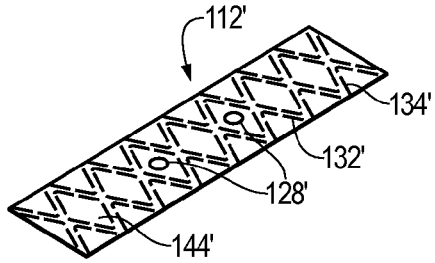
FIG. 5A is a top view of an embodiment of the void board similar to that shown in FIG. 5.
Figure 6A:
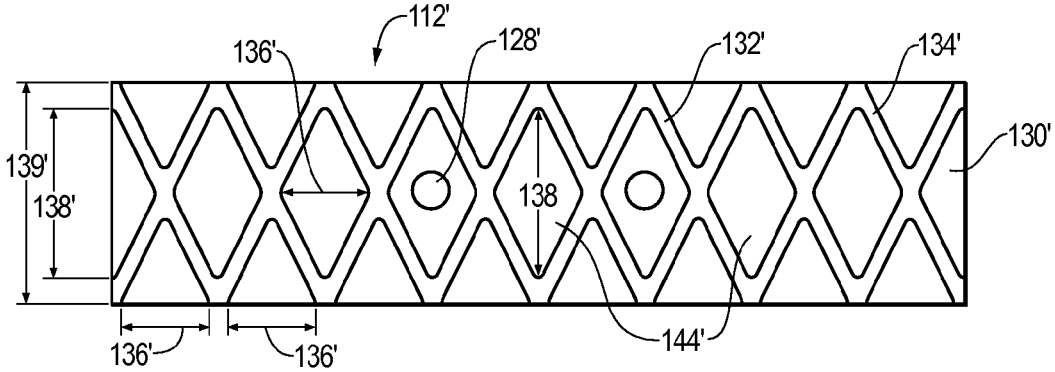
FIG. 6A is a view similar to that of FIG. 6 illustrating the void board of FIG. 5A

An alternate embodiment 112' of the diamond pattern board is illustrated in FIGS. 5A and 6A. In this embodiment 112', holes 128' are formed In the void spaces 144' which reduce the effect of static electricity and facilitate lift and separation of the board 112' from adjacent boards 112'. The holes 128' can be centered within the diamond spaces 144', in a uniform repeating pattern.

Advantageously, in all of the embodiments, the strength of the board 12, 12', 112, 112' is preserved even with less material used to fabricate the sheet. This is accomplished by providing structural shapes to define the board.

Optionally, the enhanced void board 12, 12' can be formed having one or more weakened, frangible regions 48, 48' formed in the enhanced void board 12, 12'. The weakened regions 48, 48' can be made by forming a score, crease or perforation in the board 12, 12'. The weakened regions 48, 48' extend parallel to and between the ribs 32, 34, 32', 34'. The weakened regions 48, 48' permit separating the enhanced void board 12, 12' cleanly between aligned ribs 32, 34, 32', 34' and within the same void space 44 after, for example, the bricks forming a vertical layer 50 of the bundle 10 (see FIG. 2) are removed. In this manner, the remaining board is not extending out beyond the bundle 10 as would be with a solid sheet. It is understood that frangible regions also may be formed in alternate embodiments with alternate rib configurations and intended to fall within the spirit and scope of the present invention.

The board 12, 12', 112, 112' can be formed from a wide variety of readily available materials. A present board 12, 12', 112, 112' is made from a low melt-strength, inexpensive polymeric material and each board 12, 12', 112, 112' is, preferably, an extruded member. Anticipated materials include polyvinyl chloride (PVC), acrylonitrile butadiene styrene (ABS), polystyrene (PS), polyethylene (PE), and other similar polymers and blends thereof. Those skilled in the art will appreciate these and other suitable materials.

Figure 2:
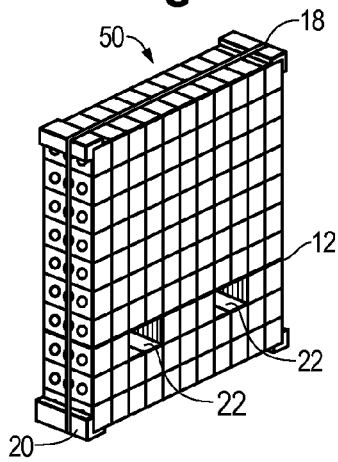
FIG. 2 is a perspective view of one vertical layer of bricks separated from the bundle of FIG. 1.

In addition to the enhanced stability and reduced "crush" afforded by the present void board 12, 12', 112, 112', an additional benefit of the present board is the ability to remove a vertical brick layer 50 (removed perpendicular to the direction of the fork prong openings 22 as seen in FIG. 2), without having to contend with static electricity or other adhering qualities of the polymeric material.

In the disclosure, the use of the disjunctive is intended to include the conjunctive. The use of the definite article or indefinite article is not intended to indicate cardinality. In particular, a reference to "the" object or "a" or "an" object is intended to denote also one of a possible plurality of such objects.

All patents referred to herein, are hereby incorporated herein by reference, whether or not specifically done so within the text of this disclosure.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An enhanced polymeric void board for placement between adjacent horizontal layers of bricks to maintain an opening in a lower of the layers, the enhanced void board comprising:

a thin planar element having a length, a width and a thickness, the thin planar element being contiguous and devoid of openings, the width defined by parallel edges, the planar element defining first and second surfaces and having a plurality of wide ribs extending outwardly from one of the first and second surfaces and fully along the length of the planar element parallel to the edges, the ribs configured to provide stiffness to the planar element, wherein the plurality of ribs each have a width that is less than one-half of the width of the planar element, but about eight times greater than the thickness of the planar element, and have a height that is about equal to a height of the others of the ribs, a spacing between adjacent ribs being greater than the width of the ribs, the height of the ribs being about equal to the thickness of the planar element, the planar element including weakened regions formed in the planar element parallel to the ribs, the weakened regions configured to provide a plurality of frangible regions for separating a portion of the planar element from a remaining portion of the planar element and wherein the ribs do not intersect one another.

2. The enhanced polymeric void board in accordance with claim 1 wherein the height of the ribs is about equal to the thickness of the planar element.

3. The enhanced polymeric void board in accordance with claim 1 including two ribs.

4. The enhanced polymeric void board in accordance with claim 1 wherein a juncture of the ribs and the planar element is formed having a curved profile.

5. The enhanced polymeric void board in accordance with claim 4 wherein the curved profile is a concave profile.

6. The enhanced polymeric void board in accordance with claim 1 wherein the planar element is extruded from a die.

7. The enhanced polymeric void board in accordance with claim 1 wherein the planar element is formed from a thermoplastic material.

8. The enhanced polymeric void board in accordance with claim 1 wherein the planar element is formed from a thermoplastic-blend material.

9. The enhanced polymeric void board in accordance with claim 1 wherein the planar element is formed from a filled polymer.

10. The enhanced polymeric void board in accordance with claim 1 wherein the ribs are formed by embossing the surface of the planar element.

11. The enhanced polymeric void board in accordance with claim 1 wherein an on-center distance between the ribs is about 2.500 inches.

* * * * *

UNITED STATES PATENT AND TRADEMARK OFFICE

CERTIFICATE OF CORRECTION

PATENT NO. : 8,679,610 B2
APPLICATION NO. : 12/125303
DATED : March 25, 2014
INVENTOR(S) : Kruelle et al.

It is certified that error appears in the above-identified patent and that said Letters Patent is hereby corrected as shown below:

Title page, item (73), Assignee, line 1, "Illinoise" should read as --Illinois--.

In the Specification

Column 2, line 22, "polystryrene" should read as --polystyrene--.

Column 4, line 16, "In" should read as --in--.

Column 4, line 47, "polystryrene" should read as --polystyrene--.

Signed and Sealed this
Sixteenth Day of December, 2014

Michelle K. Lee

Michelle K. Lee
*Deputy Director of the United States Patent and Trademark Office*